US005122768A

United States Patent [19]

Ito et al.

[11] Patent Number: 5,122,768

[45] Date of Patent: Jun. 16, 1992

[54] COMPACT STRIPLINE FILTER WITH FIXED CAPACITY BETWEEN COUPLED RESONATOR FINGERS

[75] Inventors: Kenji Ito; Naomasa Wakita, both of Nagoya, Japan

[73] Assignee: NKG Spark Plug Co., Ltd., Aichi, Japan

[21] Appl. No.: 632,161

[22] Filed: Dec. 21, 1990

[30] Foreign Application Priority Data

Jan. 8, 1990 [JP] Japan ..... 2-665[U]
Jan. 8, 1990 [JP] Japan ..... 2-666[U]
Jan. 8, 1990 [JP] Japan ..... 2-667[U]

[51] Int. Cl.[5] ..... H01P 1/203
[52] U.S. Cl. ..... 333/204; 333/205
[58] Field of Search ..... 333/202, 1, 205, 219, 333/234, 235; 29/600, 825

[56] References Cited

U.S. PATENT DOCUMENTS

Re. 31,470 12/1983 Bedard et al. ..... 333/204
4,560,965 12/1985 Gosling et al. ..... 333/202 X
4,609,892 9/1986 Higgins, Jr. ..... 333/204
4,808,951 2/1989 Yamato et al. ..... 333/202
4,975,664 12/1990 Ito et al. ..... 333/204 X

FOREIGN PATENT DOCUMENTS 0071302 4/1987 Japan .
0219202 9/1988 Japan ..... 333/204

*Primary Examiner*—Robert J. Pascal
*Assistant Examiner*—Seung Ham
*Attorney, Agent, or Firm*—Darby & Darby

[57] ABSTRACT

An improved stripline filter is disclosed which includes a laminate of a pair of dielectric substrates each having an outer surface provided with a ground conductor, and conducting resonator means provided between each of the two adjacent dielectric substrates and having a plurality of parallel resonator fingers each having an open circuit end and a base end electrically connected to said ground conductor, in which the ground conductor has extended portions corresponding in number to the number of the resonator fingers, each of the extended portions extending toward the open circuit end of the corresponding resonator finger and terminating with a predetermined space from the open circuit end of the corresponding resonator finger.

7 Claims, 6 Drawing Sheets

COMPACT STRIPLINE FILTER WITH FIXED CAPACITY BETWEEN COUPLED RESONATOR FINGERS

BACKGROUND OF THE INVENTION

This invention relates to a stripline filter suited for utilization in small-sized electric circuits.

In general, a stripline filter includes a pair of opposing, dielectric substrates each having an outer surface provided with a ground conductor, and conducting resonator fingers of a stripline pattern provided between the dielectric substrates and each having an open circuit end and a base end electrically connected to the ground conductor. Such a filter is utilized as a bandpass filter in the microwave frequency region.

The response characteristics of such stripline filters depend on the size of the resonator fingers and the shape of the dielectric substrates. Thus, a variation in such a size and a shape will cause a variation in coupling capacity of the filter so that the frequency to which the filter responds deviates from a predetermined frequency range.

The coupling capacity on the open circuit end side of each of the resonator fingers depends on the aperture distance between the open circuit end and the opposing ground conductor. Thus, as long as the length of the space between the resonator finger and the opposing ground conductor is not varied, the coupling capacity on the side of the open circuit end is maintained constant. For example, in the case of a stripline filter of an apron type in which, as shown in FIG. 2 of the accompanying drawings which will be described hereinafter, resonant fingers are connected to apron conductor portions 6*e* and 6*f* formed on the periphery of the dielectric substrate, the coupling capacity may be made constant by setting the distance between the open circuit ends and the apron conductor portions to a predetermined value.

However, the resonator fingers differ in shape from each other. In the case of a resonator with three stripline fingers, for example, the fingers of both sides have output and input terminals while the center finger has no such terminal. As a result, the length of the fingers should be separately determined with consideration of their electrical connection modes. In general, the center finger should be slightly longer than the fingers on the both sides. Since the apron conductor portions are those to which the base ends of fingers are connected and, hence, serve as basal portions to determine the length of each finger, the length of the opposing apron conductor portions is not to be varied. Thus, it is not possible to regularize the coupling capacities on the side of the open circuit ends of the resonator fingers by controlling the distance between the apron conductor portions. In the conventional stripline filters, therefore, the coupling capacities on the open circuit end sides are not uniform and it is necessary to trim the resonance frequency characteristics after fabrication thereof.

On the other hand, in the dielectric filter, the conductors are exposed on the outer surface of dielectric substrates. Considering from this fact, the following disadvantages are induced. The first is that the conductor is easily to be oxidized; the second is that this is easy to be abraded or ablated from the outer surface of the substrates; the third is that, since it is necessary to avoid the unnecessary electrical contact with the conductor, the use is not easy.

OBJECTS OF THE INVENTION

One of the objects of the present invention has been made with the foregoing problems of the conventional stripline filter in view and is aimed at the provision of a stripline filter having predetermined coupling capacities on the side of the open circuit ends.

Another object of the invention has been also proposed to remove the disadvantages which are derived from the fact that the conductors are exposed on the outer surface of dielectric substrates.

BRIEF DESCRIPTION OF THE INVENTION

In accordance with the present invention there is provided a stripline filter comprising a laminate of a plurality of dielectric substrates having an outer surface provided with a ground conductor, and conducting resonator means provided between each of the adjacent two dielectric substrates and including a plurality of parallel resonator fingers each having an open circuit end and a base end electrically connected to said ground conductor. The ground conductor has extended portions corresponding in number to the number of said resonator fingers, each of said extended portions extending toward the open circuit end of the corresponding resonator finger and terminating with a predetermined space from the open circuit end of the corresponding resonator finger.

BRIEF DESCRIPTION OF THE DRAWINGS

The present invention will now be described in detail below with reference to the accompanying drawings in which.

DETAILED DESCRIPTION OF THE INVENTION

Figure 1:
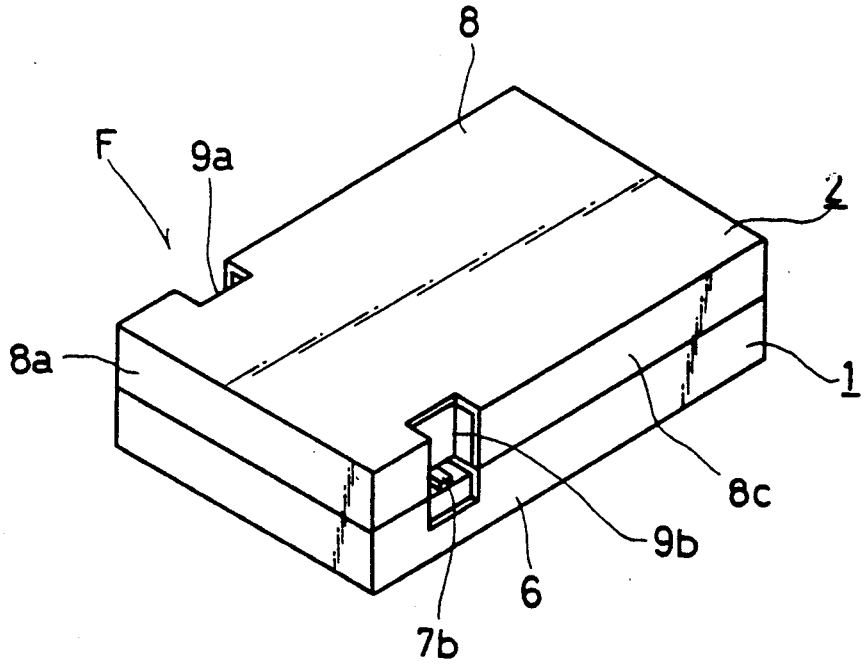
FIG. 1 is a perspective view showing a stripline filter of the present invention in an assembled state.
Figure 2:
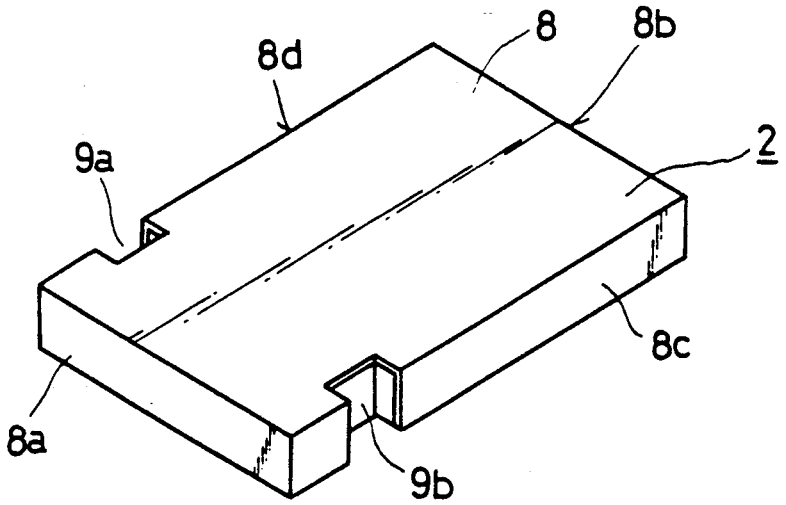
FIG. 2 is a schematic, exploded, perspective view of the filter of FIG. 1.
Figure 2:
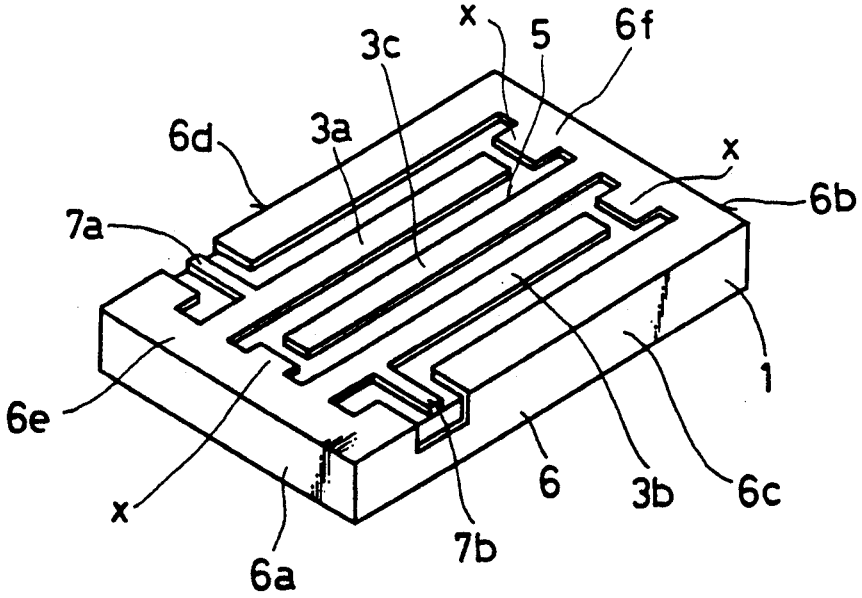

Referring now to FIGS. 1 and 2, designated generally as F is a stripline filter according to the present invention. The filter F has lower and upper dielectric substrates 1 and 2 each formed of a dielectric ceramic having a high dielectric constant and a low loss, such as $BaO\text{-}TiO_2$ or $BaO\text{-}TiO_2$-rare earth. The two substrates 1 and 2 are provided with ground conductors 6 and 8, respectively on their outer surfaces. The ground conductors 6 and 8 extend to side surfaces 6*a*–6*d* and 8*a*–8*d*, respectively. Further, the ground conductor 6 extends to the periphery of the inside surface of the substrate 1 to form apron conductors 6*e* and 6*f*.

A conducting resonator member 5 having a plurality of fingers (three fingers in the illustrated case) 3*a*, 3*b* and 3*c* is formed on the inner surface of the lower substrate 1. Each finger has a base portion electrically connected to the apron conductor 6*e* or 6*f* with the other end thereof terminating to form an open circuit end. These fingers 3*a*–3*c* are arranged in an alternate, interdigital form and have a length corresponding to ¼ or ½ wavelength. The both side fingers 3*a* and 3*b* have laterally extended portions 7*a* and 7*b*, respectively, serving as input and output terminals for the filter and, therefore, differ in shape from the center finger 3*c*. Because of this difference, the lengths of the outer fingers 3*a* and 3*b* are made shorter than that of the center finger 3*c*.

The construction of the resonator means is not limited only to the above. For example, the resonator member 2 may be formed on both of the substrates 1 and 2, if desired. In this case, the two resonator members of respective dielectric substrates 1 and 2 are arranged in a mirror image relation and, in an assembled state, are disposed in face contact with each other to form a resonator member 5 between the two substrates 1 and 2. Further, the fingers of the resonator member 5 may be arranged in a comb-like pattern.

Designated as 9*a* and 9*b* are retracted portions optionally provided in the upper dielectric substrate 2 at positions adjacent to the terminals 7*a* and 7*b* of the lower substrate 1 to facilitate the connection between the terminals 7*a* and 7*b* and a printed circuit board (not shown).

Figure 3:
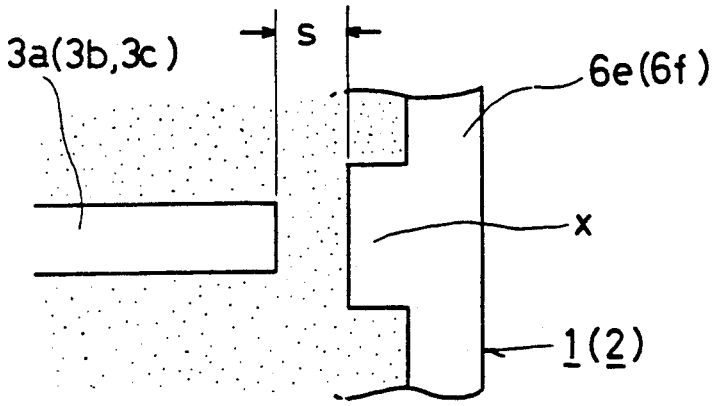
FIG. 3 is an enlarged, fragmentary plan view showing a part of the present invention.

The apron conductors 6*e* and 6*f* have extended portions x extending toward the open circuit ends of the resonator fingers 3*a*–3*c*. As shown in FIG. 3, the extended portions x terminate with predetermined apertures s from the open circuit ends of respective resonator fingers 3*a*–3*c*. The formation of the extended portions x may be effected by, for example, screen printing simultaneously with the formation of the conducting resonator member 5.

Thus, the extended portions x determine aperture distances x so that the coupling capacities on the side of the open circuit ends can respectively be made constant by suitably adjusting the length of the extended portions x.

It has been found that the coupling capacity increases with the reduction of the aperture distance s. When the coupling capacity is high, the desired resonance frequency may be obtained even if the length of the resonator finger is reduced. Therefore, by increasing the length of the extended portion x to reduce the aperture distance s, it is possible to reduce the length of the resonator fingers while keeping the resonance frequency unchanged. Thus, the stripline filter can be made compact according to the present invention.

Figure 4:
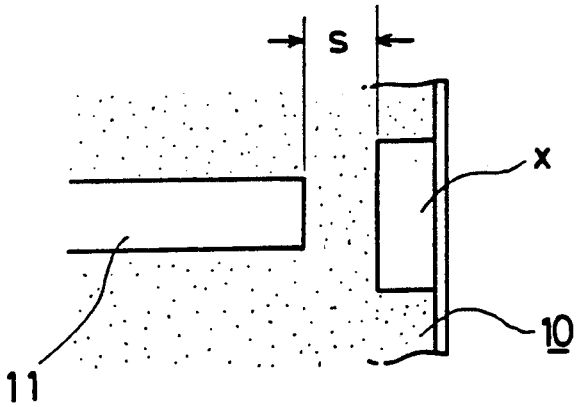
FIG. 4 is a view, similar to FIG. 3, showing another embodiment of the present invention.

FIG. 4 illustrates another embodiment of the present invention, wherein the ground conductor does not extend to the inner surface of a dielectric substrate 10, i.e. no apron conductors are provided. Similar to the above embodiment, an extended portion x is provided opposite to the open circuit end of a resonator finger 11 with an aperture of a length s therebetween.

Figure 5:
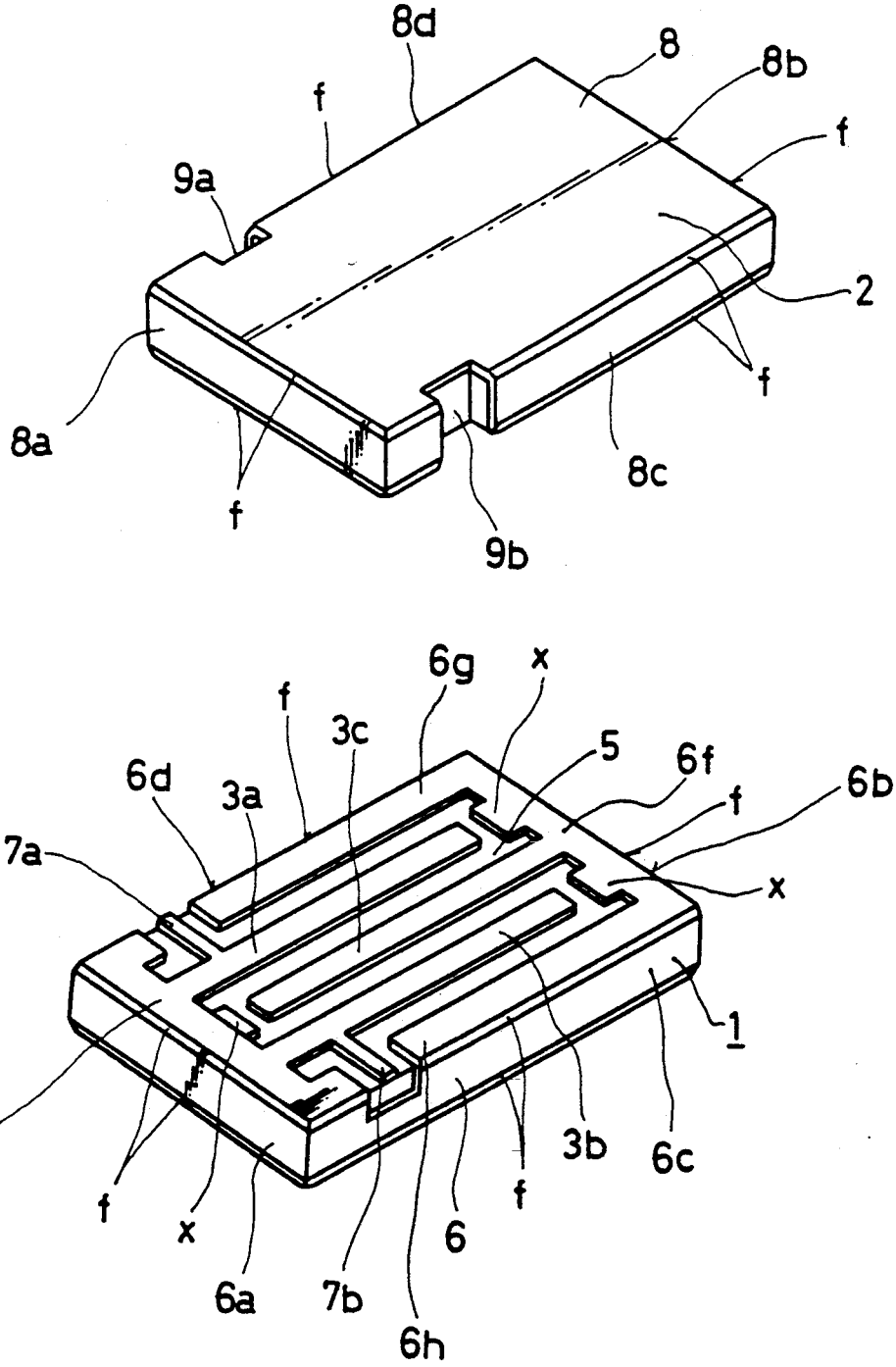
FIG. 5 is an exploded, perspective view, similar to FIG. 2, showing a further embodiment of a stripline filter of the present invention.
Figure 6:
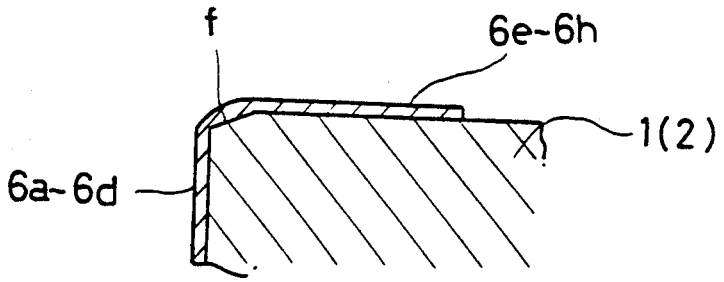
FIG. 6 is an enlarged, cross-sectional, fragmentary view showing a chamfered edge of the filter of FIG. 5.
Figure 7:
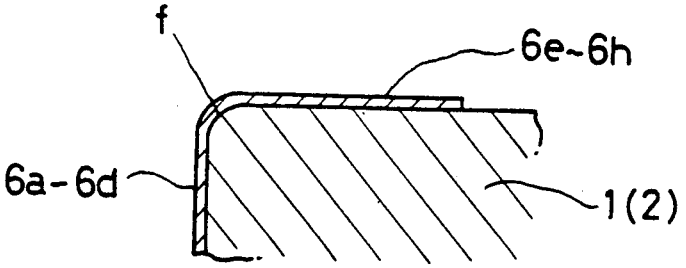
FIG. 7 is a view, similar to FIG. 6, showing another embodiment of the present invention.

FIG. 5 illustrates a further embodiment of the present invention, wherein each of the eight edges of the top and bottom surfaces of each of the lower and upper dielectric substrates 1 and 2 are chamfered. The chamfers f may be as a sloped face as shown in FIG. 6 or as a rounded face as shown in FIG. 7. The advantages accruing from the provision of chamfers f are as follows.

Figure 8:
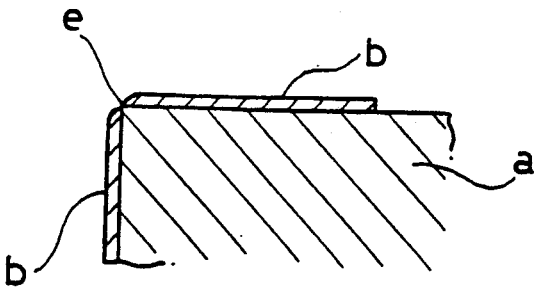
FIG. 8 is a view, similar to FIG. 6, showing an edge without being chamfered.

As shown in FIG. 8, when a dielectric substrate a is covered with conducting layers b such as ground conductors and apron conductors, the thickness of the conducting layer at the edge portion e which is not chamfered is unavoidably thin irrespective of whether the formation of the layer is effected by plating, printing or any other known methods. As a result, there is a possibility of electrical disconnection at the edge portions or of deterioration of characteristics as a bandpass filter. The formation of the chamfers f, on the other hand, permits the formation of a conducting layer with a thickness sufficient to prevent electrical disconnection at the chamfered edges and to stabilize the wave filtering characteristics of the filter.

More particularly, as shown in FIG. 5, edges between the side wall conductors 6*a*–6*d* and the apron conductors 6*e*–5*h* on the lower dielectric substrate 1 can be thick enough to provide good electrical connection with each other. This also applies to the upper dielectric substrate 2. Also, edges defined between the top ground conductor and side wall conductors 8*a*–8*d* of the upper dielectric substrate 2 can be thick enough to provide good electrical connection therebetween. This also applies to the lower dielectric substrate 1. In the embodiments shown in FIGS. 5–7, the edges between each of the two neighboring side walls 6*a*–6*d* and 8*a*–8*d* may be chamfered, if desired.

Figure 9:
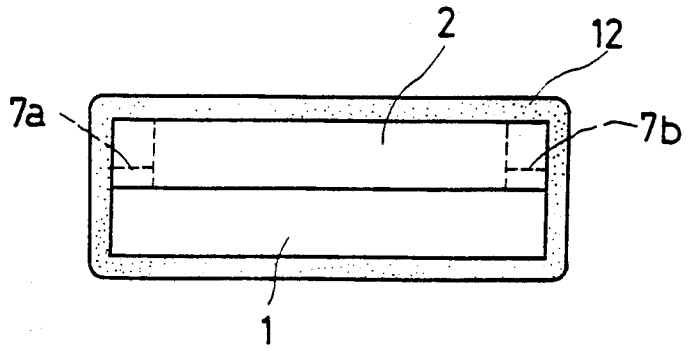
FIG. 9 is an elevational view, cut away in part, showing a further embodiment of the present invention.

FIG. 9 illustrates a embodiment of the another invention in which the entire outer surface of the laminate is surrounded by an electrically insulating resin layer 12 except for the terminal portions 7*a* and 7*b* in the recessed portions 9*a* and 9*b*. In the embodiment shown in FIG. 10, the terminals 7*a* and 7*b* are extended to lower side of the lower dielectric substrate 1 and the insulating layer 12 is provided to cover the entire surface except for the lower side. In the embodiment shown in FIG. 11, the terminals 7*a* and 7*b* are extended to the lower side of the lower dielectric substrate 1 and the insulating layer 12 is provided to surround the entire surface of the filter A except for the terminal portions 7*a* and 7*b*. The terminal portions 7*a* and 7*b* are covered with a conductive coating 13 having the same thickness as that of the insulating layer 12 so as to provide flat surface.

Figure 10:
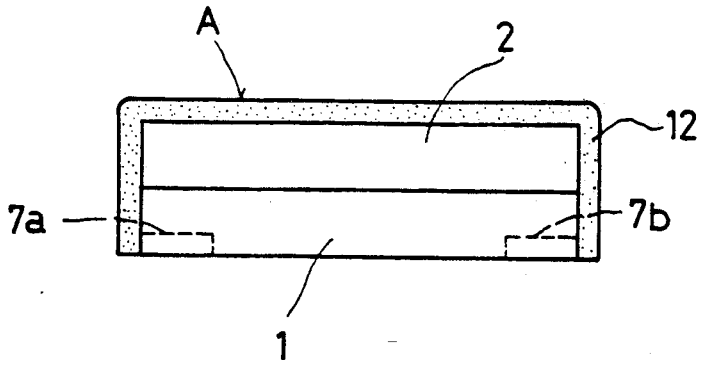
FIGS. 10 and 11 are views similar to FIG. 9, showing further embodiments of the present invention.
Figure 11:
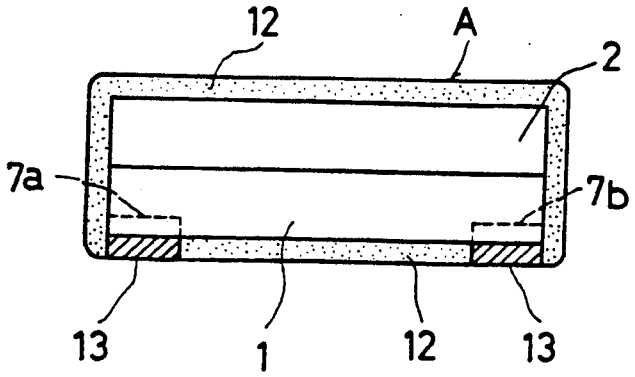

The insulating layer 12 provided as shown in FIGS. 9–11 can protect the ground conductor and can improve resistance of the stripline filter to moisture, oxidation, mechanical abrasion and mechanical shock so that the filter can exhibit optimum wave-filtering effect in a stable manner for a long period of service.

Although the foregoing descriptions have been made with reference to stripline filters having a pair of upper and lower dielectric substrates and a pair of poles, the present invention are not limited to those embodiments only. The number of the dielectric substrates and/or the number of the poles may be increased, as desired, in the present invention.

What is claimed is:

1. A stripline filter comprising a laminate of a pair of dielectric substrates each having an outer surface, at least one of which outer surfaces having a ground conductor thereon, a conducting resonator means between the two adjacent dielectric substrates of the laminate and including a plurality of parallel resonator fingers each having an open circuit end and a base end electrically connected to said ground conductor, said ground conductor having extended portions corresponding in number to the number of said plurality of resonator fingers, each of said extended portions extending toward the open circuit end of the corresponding resonator finger and terminating with a predetermined space from the open circuit end of the corresponding resonator finger.

2. A stripline filter comprising a laminate of a pair of dielectric substrates each having an outer surface, at least one of said outer surface having a ground conductor thereon, and conducting resonator means provided between the adjacent two dielectric substrates of the laminate and including a plurality of parallel resonator fingers each having an open circuit end and a base end electrically connected to said ground conductor, one of said substrates having at least one opening to provide access to the terminal end of said resonator means, and a layer of electrically insulating resin material on said ground conductor on the outer surface of said laminate except at the terminal openings leading from the conducting resonator means.

3. A stripline filter as set forth in claim 1, wherein each of the edges of said laminate substrate outer surface provided with the ground conductor is chamfered.

4. A stripline filter as set forth in claim 2, characterized in that each of the edges of said laminate provided with the ground conductor is chamfered.

5. A stripline filter as in claim 1 wherein each said dielectric substrate has a ground conductor on its outer surface.

6. A stripline filter comprising a laminate of a pair of dielectric substrates each having an outer surface with at least one said outer surface having a ground conductor thereon, and conducting resonator means provided between the adjacent two dielectric substrates of the laminate and including a plurality of parallel resonator fingers each having an open circuit end and a base end electrically connected to said ground conductor, and a layer of electrically insulating resin material on the ground conductor except at the terminal portions leading from the conducting resonator means, thereon being the outer edges of a substrate covered with the ground conductor are chamfered.

7. A stripline filter as in claim 2 wherein each said dielectric substrate has a ground conductor on its outer surface, each said ground conductor being covered by a layer of electrically insulating resin material.

* * * * *